United States Patent [19]

Dewhurst et al.

[11] Patent Number: 4,829,574

[45] Date of Patent: May 9, 1989

[54] SIGNAL PROCESSING

[75] Inventors: David J. Dewhurst, Victoria, Australia; Chee W. Ng, Kuala Lumpur, Malaysia; Murray A. Hughes; Donald A. H. Johnson, both of Victoria, Australia

[73] Assignee: The University of Melbourne, Victoria, Australia

[21] Appl. No.: 153,504

[22] Filed: Feb. 1, 1988

Related U.S. Application Data

[63] Continuation of Ser. No. 620,832, Jun. 15, 1984, abandoned.

[30] Foreign Application Priority Data

Jun. 17, 1983 [AU] Australia ..... 29446/84

[51] Int. Cl.[4] ..... G10L 5/00

[52] U.S. Cl. ..... 381/41; 381/43

[58] Field of Search ..... 381/29–50

[56] References Cited

U.S. PATENT DOCUMENTS

| | | | |
|---|---|---|---|
| 3,327,058 | 6/1967 | Coker | 381/39 |
| 3,349,183 | 10/1967 | Campanella | 381/31 |
| 3,649,765 | 3/1972 | Rabiner et al. | 381/39 |
| 3,989,896 | 11/1976 | Reitboeck | 381/50 |
| 4,076,960 | 2/1978 | Buss et al. | 364/513.5 |

OTHER PUBLICATIONS

Flanagan, J. L. *Speech Analysis, Synthesis, and Perception,* Springer–Verlag (New York, 1972) various pages.

Hamming, R. W., *Digital Filters,* Prentice Hall, Englewood Cliffs, New Jersey, 1977, pp. 104–107.

Freudberg et al., "An All-Digital Pitch Excited Vocoder Technique using the FFT Algorithm", IEEE Conference on Speech Communications and Processing, 1967.

Satoshi Imai & Yoshiharu Abe, "Spectral Envelope Extraction by Improved Cepstral Method", Electronics and Communications in Japan, vol. 62–A, No. 4, 1979.

*Primary Examiner*—Emanuel S. Kemeny

*Attorney, Agent, or Firm*—Bernard, Rothwell & Brown

[57] ABSTRACT

The disclosed system for extracting desired information from a speech signal includes means for taking overlapping samples of an utterance, computer means programmed to test each sample to determine whether it is voiced or unvoiced and for performing the following operations on each voiced sample: applying a 30 ms. Hamming window to smooth the edge of the signal and to ensure that false artifacts will not be present in the following processing stage, obtaining a magnitude spectrum using at least 1024 points Fast Fourier transform, obtaining the log of the magnitude spectrum, compressing the spectrum, performing a three-point filter algorithm a suitable number of times, expanding the spectrum so obtained and locating the dominant peaks in the resulting spectrum to give the information content contained in said speech signal. The specification also discloses the time equivalent of the above method. The transformed spectrum is smoothed to suppress low amplitude peaks at harmonics of the pitch frequency.

18 Claims, 13 Drawing Sheets

FIG. 3 - PRIOR ART

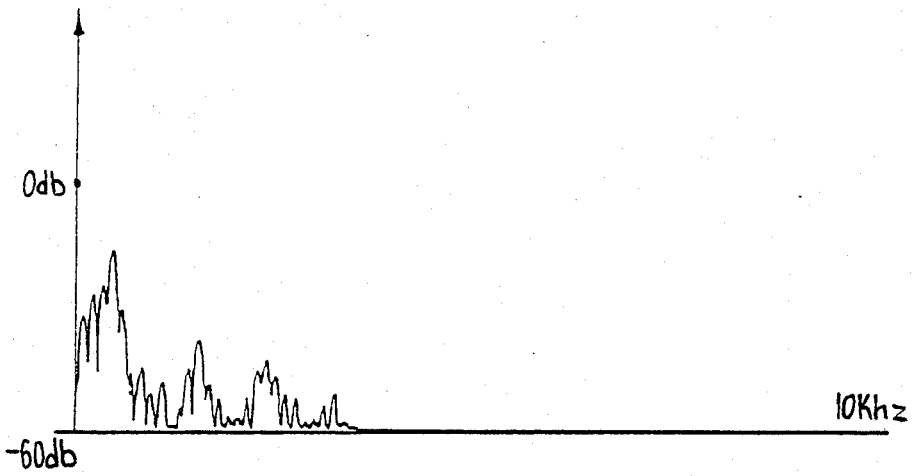
FIG. 4.
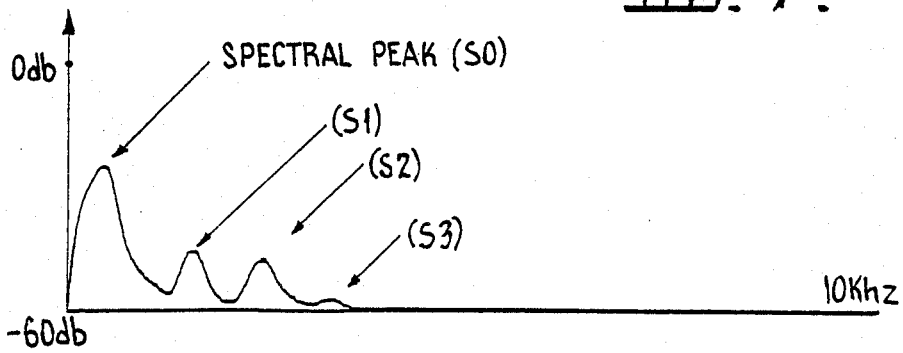
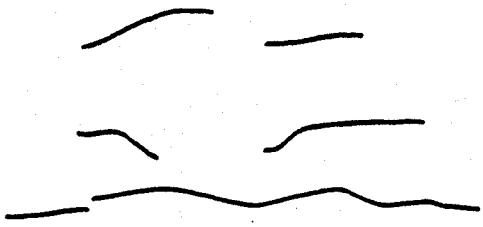
FIG. 17.
FIG. 17A.
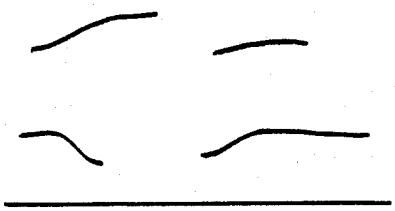

SYSTEM OVERVIEW

REAL TIME SPEECH SYNTHESIS BY DECODING SPECTRAL PEAK INFORMATION.

SIGNAL PROCESSING

This is a continuation of application Ser. No. 620,832 filed June 15, 1984, now abandoned.

BACKGROUND OF THE INVENTION

This invention relates to a system for the processing of signals to extract desired information. The invention is particularly applicable to the extraction of the desired information content from a received speech signal for subsequent use in activating or stimulating an implantable hearing prosthesis or for other purposes.

The variability of speech signals between speakers of the same utterance (as shown in FIG. 1) has been a major problem faced by all speech scientists. However, the fact that human auditory system is capable of extracting relevant speech information from widely varying speech signals has baffled speech researchers for decades. The information must of course be present in the signal but thus far researchers in this field have been unable to devise a system for reliably extracting the information from a speech signal.

The retrieval of text from voice involving recognition of unrestricted speech is still considered to be far beyond the current state of the art. What is being attempted is automatic recognition of words from restricted speech. Even so, the reliability of these ASR (Automatic Speech Recognition) systems is unpredictable. One report ("Selected Military Applications of ASR Technology" by Woodward J. P. & Cupper E. J., IEEE Communications Magazine, 21, 9 December 1983, pg 35–41) lists eighty different factors which can affect their reliability. Such advances in ASR as have been achieved have arisen more from improved electronics and microprocessor chips than from the development of any new technology for ASR.

One type of prior art speech recognition technology, as exemplified by James L. Flanagan, Speech Analysis Synthesis and Perception, Second Edition, Springer-Verlog, New York, 1972, utilizes the identification and tracking of spectral peaks or formants in the speech signal to recognize phonemes or words. First the time domain speech signal is converted into frequency domain spectrums, e.g., by a bank of bandpass filters or by computer Fourier transformation of time segments of digitized readings of the speech signal. The dominant spectral peaks are then determined in each successive spectrum and tracked in the successive spectrums. However, practical prior art systems are limited in the number of words that each system can recognize and the reliability with which phonemes or words can be recognized. Also the prior art systems are generally limited in that each system can reliably recognize words from only one person or a limited number of people.

In considering this question, the present inventors have given consideration to the manner in which the auditory system handles widely varying speech signals and extracts the information required to make the speech signal intelligible. When sounds of speech are transmitted to the higher centers of the brain by means of the auditory system it undergoes several physiological processes.

When speech signals arrive at the middle ear, a mechanical gain control mechanism acts as an automatic gain control function to limit the dynamic range of the signal being analysed. According to the temporal-place representation, the discharge patterns of auditory nerve-fibres show stronger phase locking behaviour to spectral peaks than locking to other harmonics of the stimulus. At physiological sound level, synchrony to dominant spectral peaks saturates and responses to pitch harmonics are suppressed. The resulting effect is such that the rough appearance of the pitch harmonics are masked out.

SUMMARY OF THE INVENTION

The present inventors therefore determined that reliability in speech recognition can be greatly improved by processing either the frequency domain spectrums or the time domain speech signal so as to produce spectrums in which low amplitude peaks at pitch harmonics are suppressed to thus render the dominant spectral peaks much more identifiable. This smoothing process is found to suppress or remove speaker dependent attributes which tend to mask the true dominant spectral peaks and render these peaks less identifiable. The spectral peaks are usable to stimulate a hearing prosthesis or for other purposes, such as, speech recognition by computer, speech synthesis, and speech bandwidth compression for rapid transmission of speech.

In its broadest aspect therefor, the invention provides a method for extracting desired information from a speech signal including transforming the speech signal into a spectrum, processing either the spectrum after the transforming step or the speech signal before the transforming step so that low amplitude peaks at pitch harmonics are suppressed in the resulting spectrum, and then identifying and tracking in time the spectral peaks of the resulting spectrum.

BRIEF DESCRIPTION OF THE DRAWINGS

In the drawings:

FIG. 4 shows the effect of applying a smoothing algorithm to the signal;

FIGS. 17 and 17A show typical line representations of the utterance 'Melbourne' to be used in the synthesizer described in FIG. 16.

DESCRIPTION OF PREFERRED EMBODIMENTS

Figure 1:
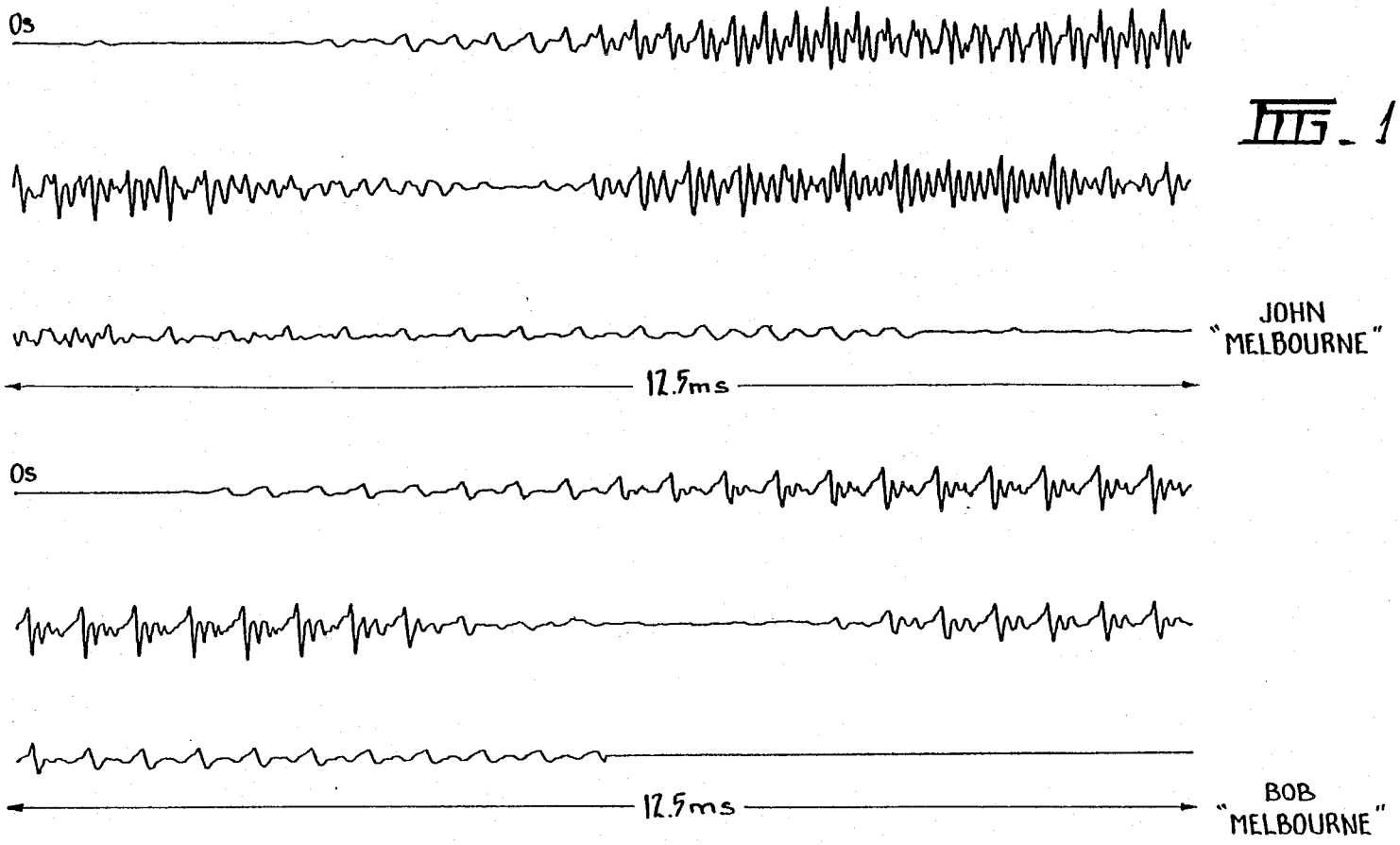
FIG. 1 is a plot showing the variability in the speech signals of two different speakers of the same utterance.
Figure 2:
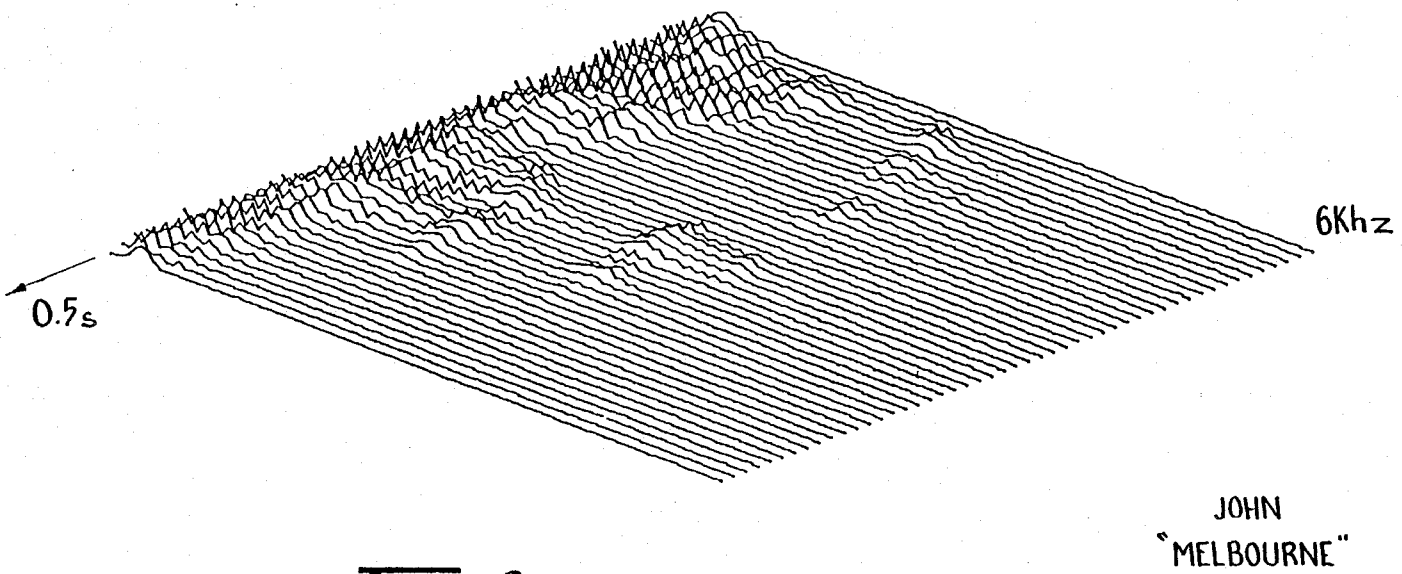
FIG. 2. PRIOR ART
FIGS. 2 and 3 are spectral plots of frequency against time of the utterance shown in FIG. 1 again showing the variability of the signals.
Figure 3:
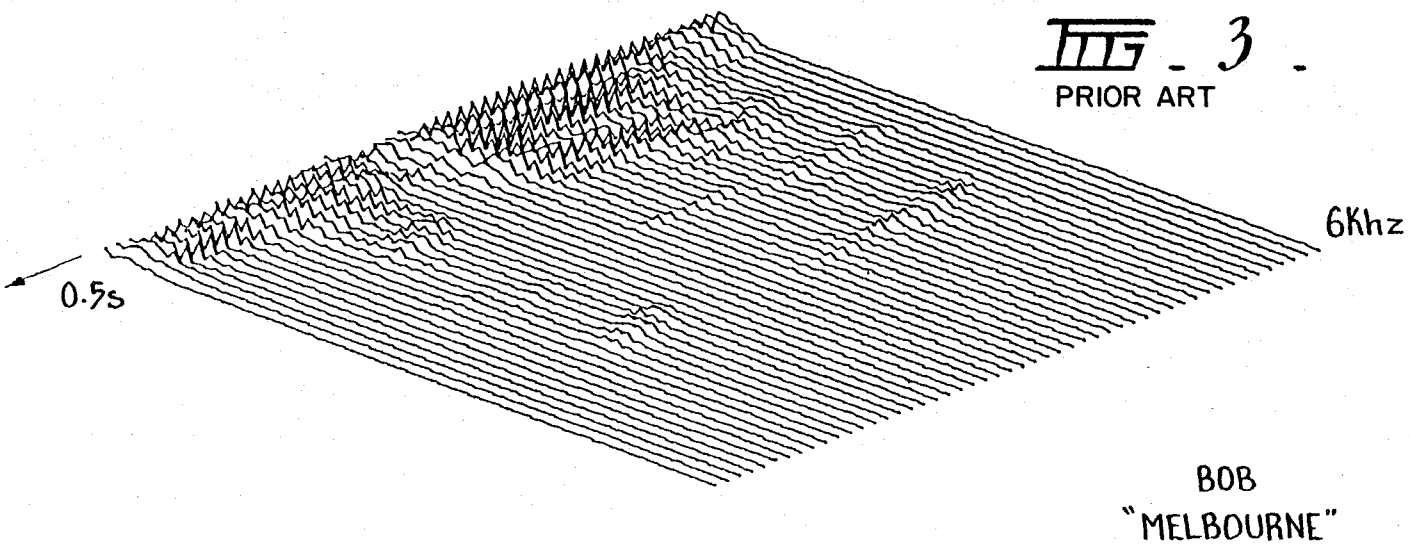
Figure 5:
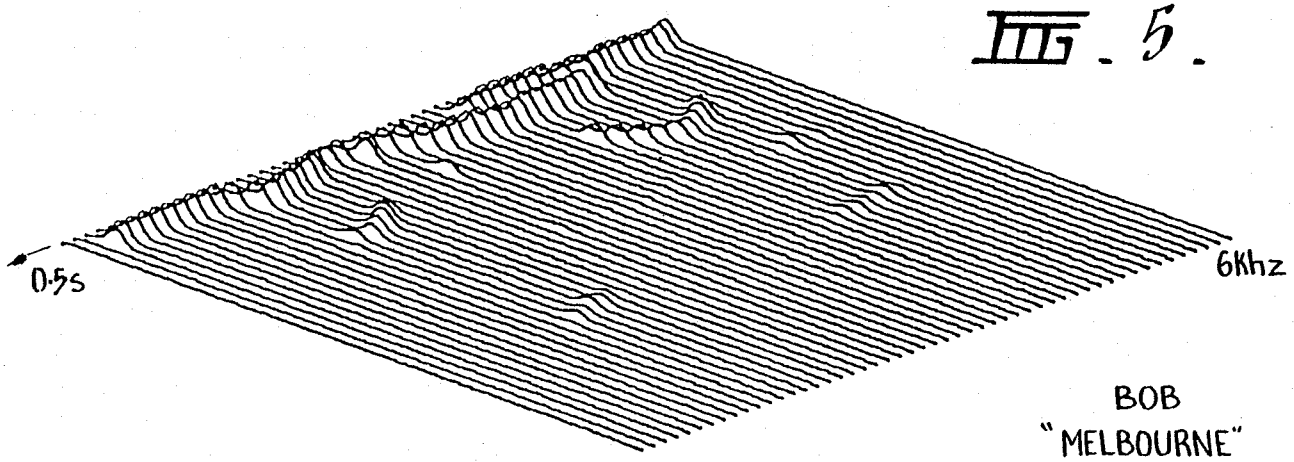
FIGS. 5 and 6 show plots of the spectral peaks produced by the smoothing shown in FIG. 4.
Figure 6:
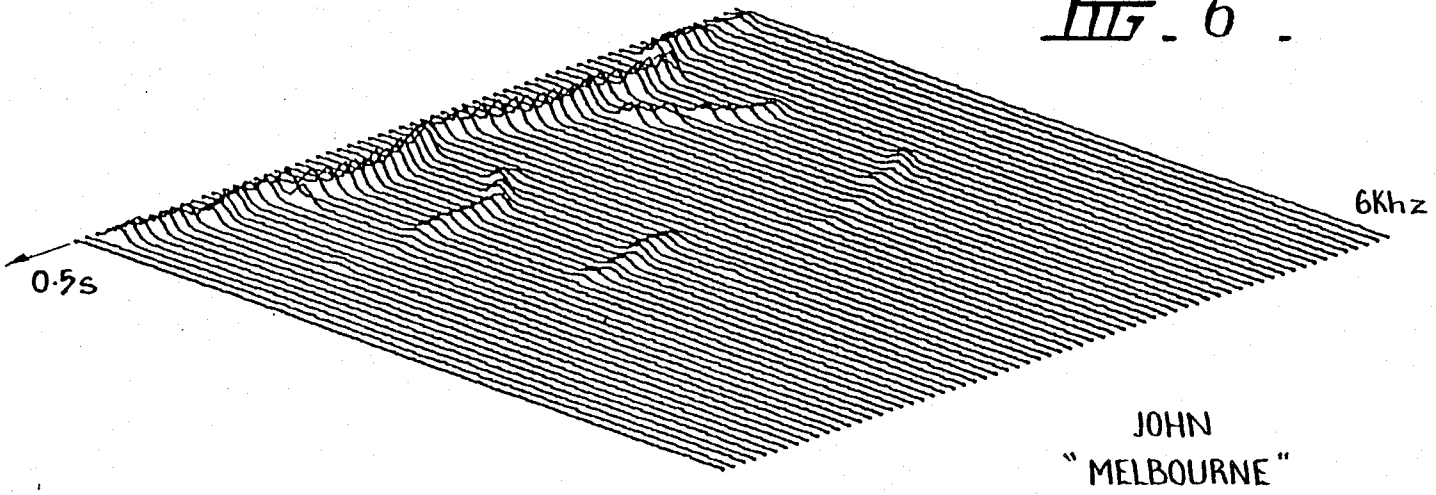

The aim of many techniques of analysing speech signals is to characterize the temporal variation of the amplitude spectra of short intervals of a word. The prior art digital method of producing a frequency spectrum of a short time segment or block of digitized speech signal data by means of the Fast Fourier Transform (FFT) yields a "messy" spectrum caused by numerous peaks pitch harmonics. Plots of these spectral variations against time shown in FIGS. 2 and 3 will be seen to be masked by the many peaks or spectrum "noise" at the dominant pitch harmonics resulting from other speaker attributes, and the sampling and FFT process. In the present method, a filtering or smoothing algorithm is performed either on the speech signal data segment block before transformation or on the spectrum data after transformation to suppress the low amplitude narrow-bandwith peaks or "noise" in the spectrum. This results in suppression or removal of the low amplitude narrow bandwidth peaks at harmonics of the pitch frequency in each spectrum of the speech signal. The center frequency and amplitude of the four locally dominant spectral peaks are much more easily picked out (see the without smoothing and with smoothing graphs in FIG. 4). Plots of these spectral peaks against time are shown in FIGS. 5 and 6. The similarities in these plots between speakers are clearly evident particularly in the direction of movement of the spectral peak tracks. Unlike formants or plots of spectral peaks tracked by prior art techniques, the spectral peaks of FIGS. 5 and 6 are discontinuous and their movements cover a wider bandwidth. There is little doubt that this concept of processing is the first step towards reliable and extensive speech perception.

Using the information acquired by the above process, a reverse processing technique can be used to resynthesize highly intelligible speech on a digital computer. The same information can be displayed in two dimensions as line patterns and by means of an optical reader these lines may be converted back into speech frequencies. Using this concept it can be demonstrated that intelligible speech can be produced on a real-time hardware synthesizer even without the pitch information previously removed in the smoothing of the spectrum.

It is envisaged that this method of speech processing can offer data rate reduction of the order of 1:40 without subjectively losing much fidelity in speech transmission.

Various methods of achieving the above described ends may be applied to the speech signal and two different approaches will now be described in greater detail.

Figure 7A:
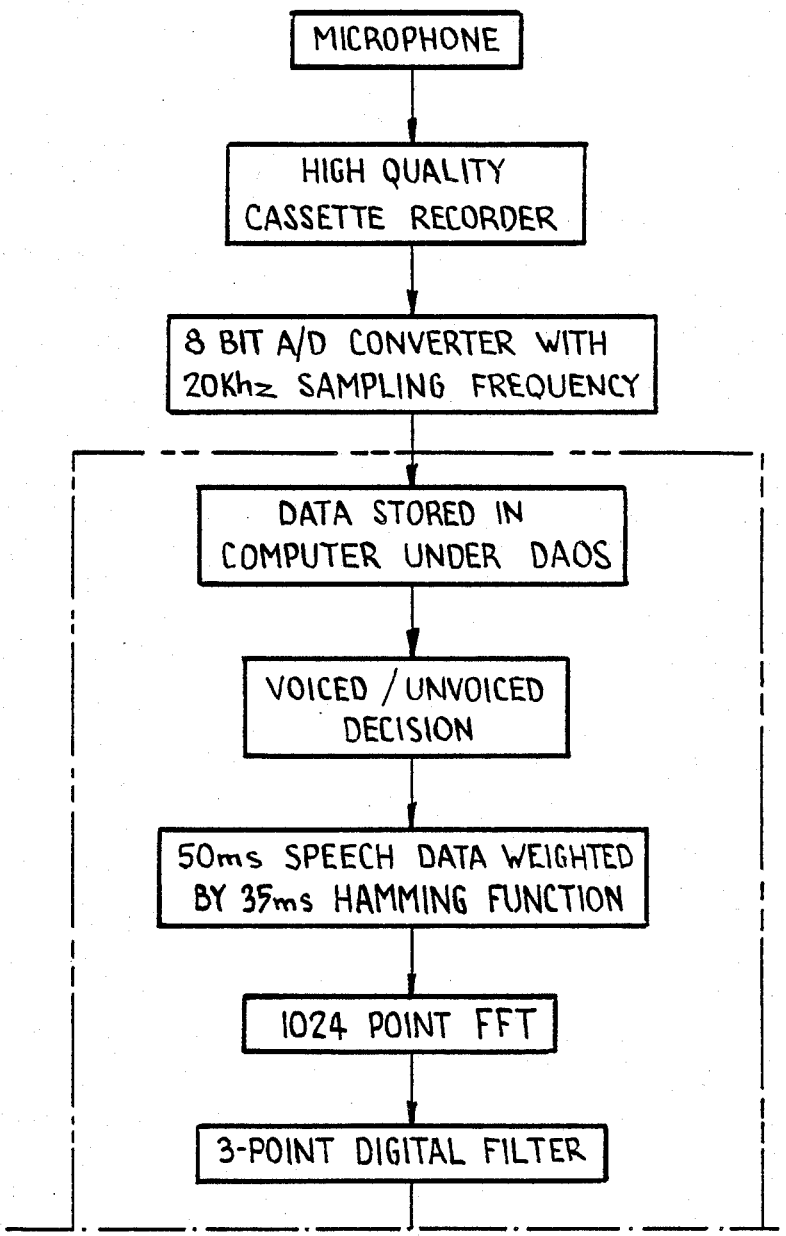
FIG. 7 is a schematic representation of one signal processing method embodying the invention.
Figure 7B:
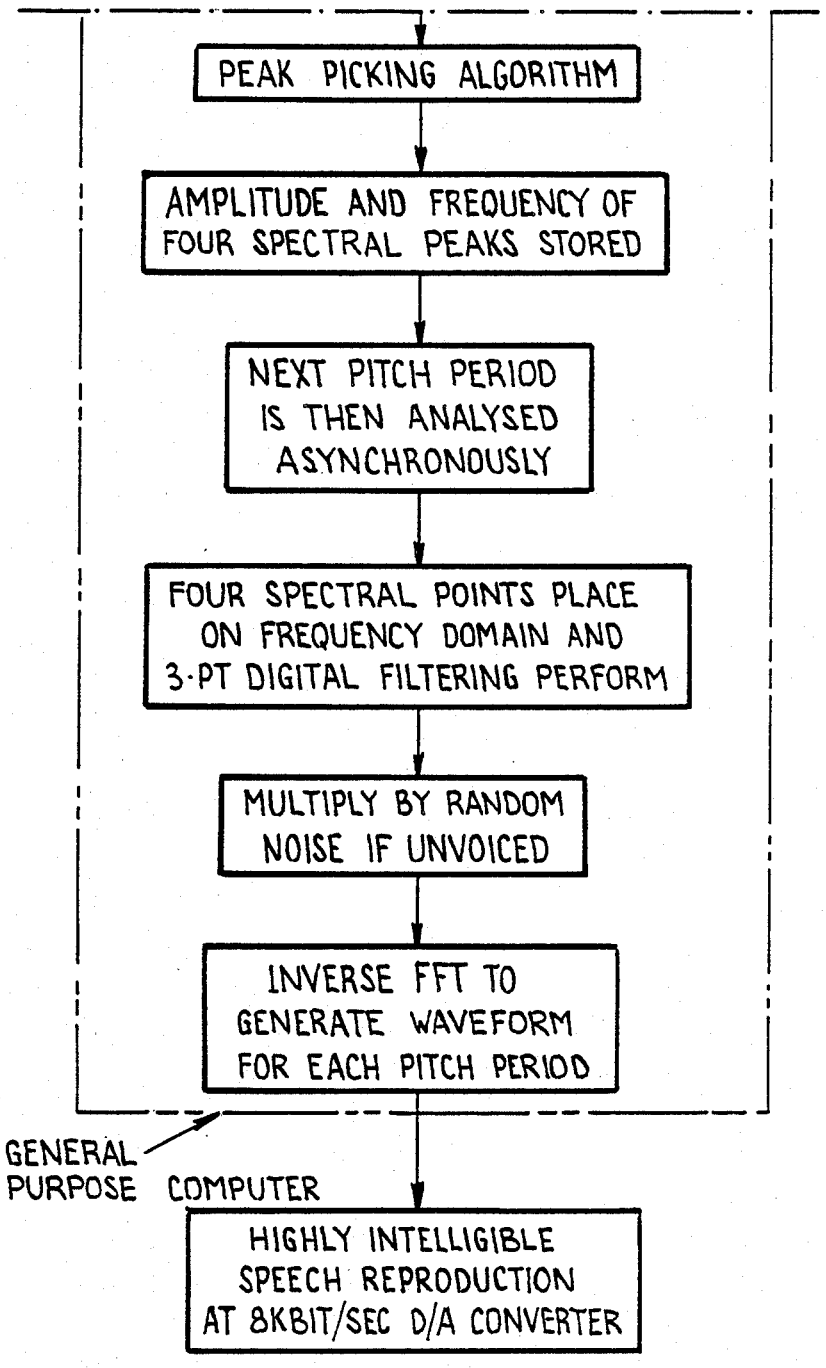
Figure 8:
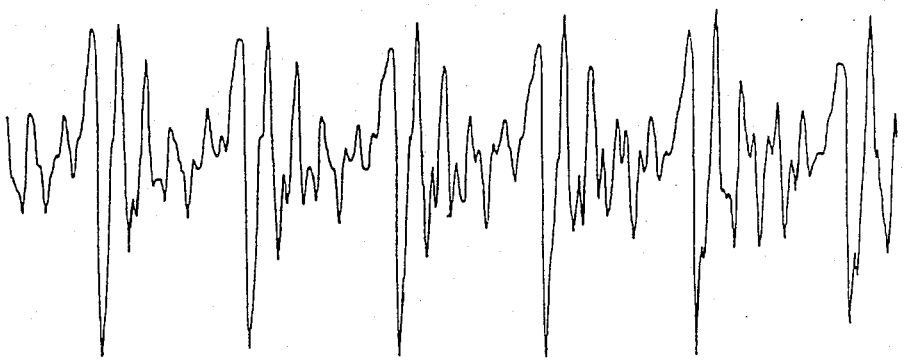
FIGS. 8 to 15 show the steps in the processing method as applied to a specific utterance.
Figure 9:
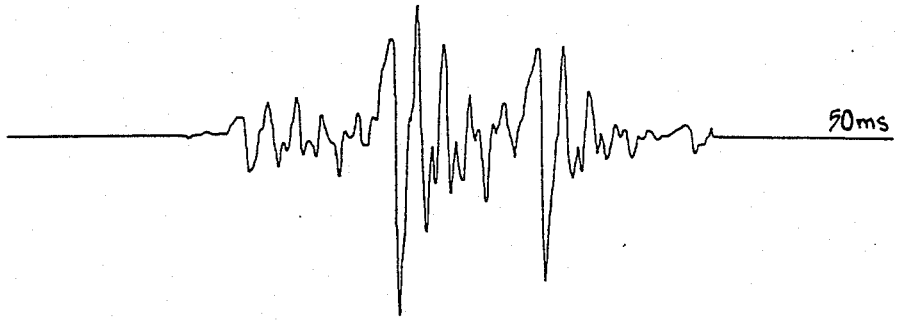
Figure 10:
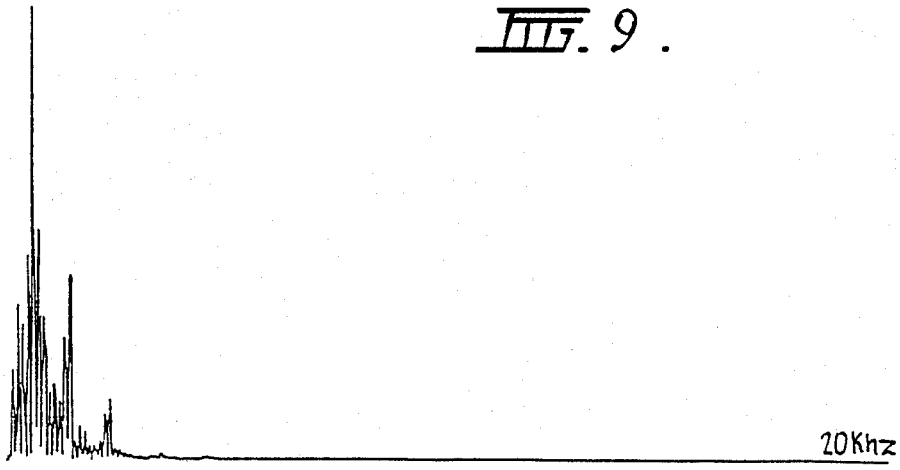
Figure 11:
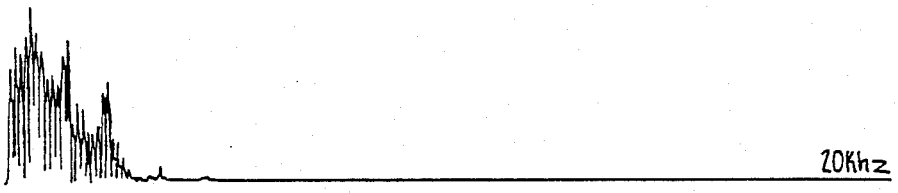
Figure 12:
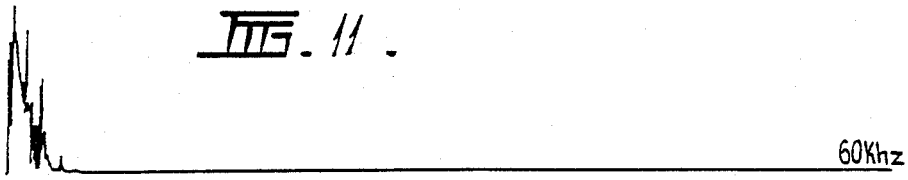
Figure 13:
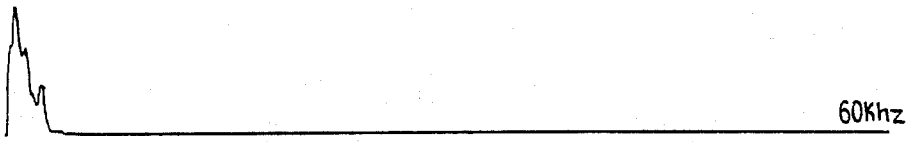
Figure 14:
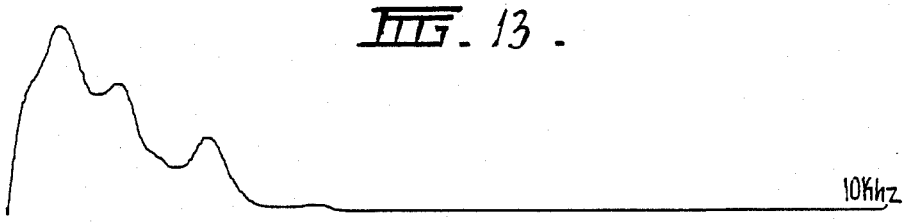
Figure 15:
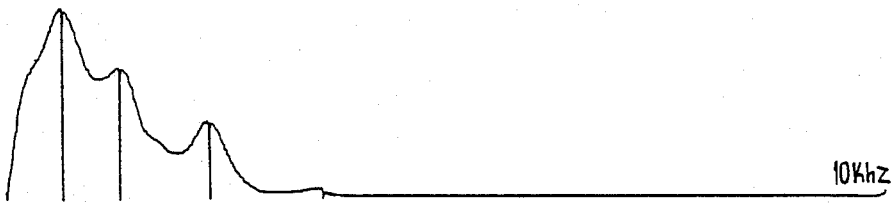

In the first processing approach wherein the spectrum data is smoothed after Fourier transformation, the signal is received and processed in the manner schematically outlined in FIGS. 7A and 7B. The process begins with the sampling of a prefiltered speech signal at a rate of about 20,000 samples per second. The sampled speech data is then analyzed in segments or blocks of 50 ms duration. Successive segments for analyzing are taken at 10 ms intervals so that there is an overlap of 40 ms of data in successive segments to provide necessary continuity. The processing technique may be better understood by considering the following example of an actual speech signal conveying the word 'boat'. The process involves the following steps of:

(a) Taking a 50 ms speech sample from the word BOAT ("O"), (FIG. 8)
(b) Applying the voiced/unvoiced test (as described further below),
(c) Applying a 30 ms Hamming window (FIG. 9) to smooth the edge of the signal and to ensure that false artifacts will not be present in the following processing stage,
(d) Obtaining a magnitude spectrum using at least 1024 points Fast Fourier Transform (FIG. 10),
(e) Log of the magnitude spectrum (FIG. 11),
(f) Spectrum compression (FIG. 12),
(g) Three-point filter algorithm is applied a suitable number of times, (FIG. 13),
(h) Spectrum is expanded as in (FIG. 14),
(i) Four dominant peaks are located as described in the mathematical details given below (FIG. 15).

Figure 15A:
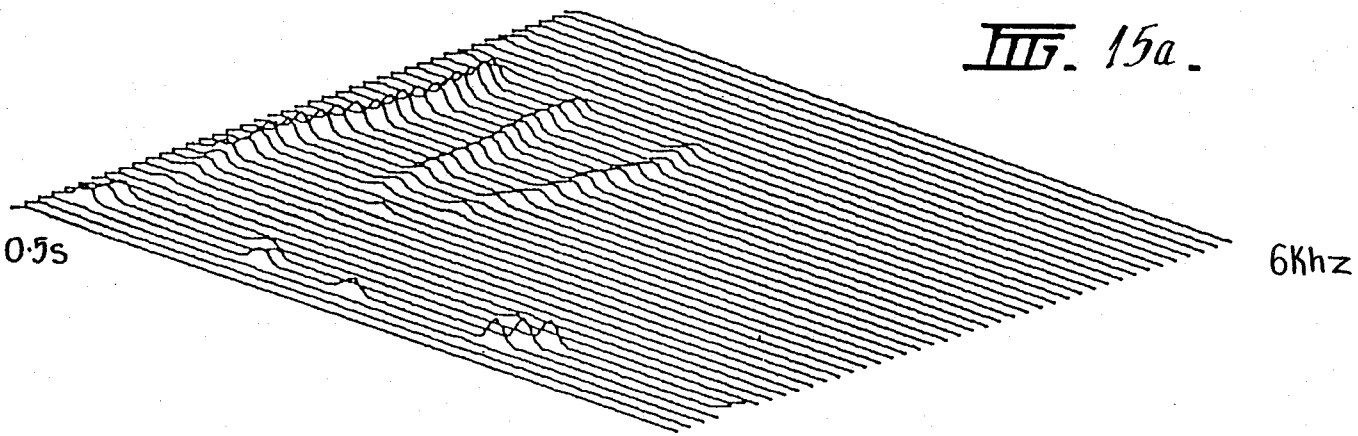
FIG. 15A is a three-dimensional plot of the spectral peak variation against time of the utterance 'Boat'.

FIG. 15A shows the spectral peaks extracted by the above method in a three-dimensional plot.

When a 50 ms segment of a speech signal is transformed by the discrete Fourier Transform process, the resulting spectrum consists of a number of frequency amplitudes occurring at frequencies which are multiples of 20 Hz. The distribution of these amplitudes as illustrated by a spectrum line across the frequency range, however, indicates the true distribution of spectral energy of the speech segment. The human observer can pick out the peaks of the spectral energy (i.e. the positions where the energy distribution has obvious maxima) by eye with little difficulty (see FIGS. 2 and 3); however, computerized recognition of the spectral peaks in each spectrum line of the prior art is much more difficult and subject to error. The present described technique enables a computer to perform the recognition task easier and more reliably since the smoothing process eliminates artifacts of the sampling process which have nothing to do with the original speech segment. The process also smooths out other features of the spectrum dependant on pitch pulse spectral energy, speaker specific characteristics and the like.

The discrete Fourier Transform is performed by the Fast Fourier Transform routine.

$$Xn(e^{j2\pi/N}) = \sum_{m=0}^{N-1} y(n-m)x(m)\, e^{-j2\pi m/N}$$

N = 1024 points y(n) is a suitable raised cosine window.

The three point filter algorithm is represented by:

$$p(n) = \left[\frac{p(n-1)}{4} + \frac{p(n)}{2} + \frac{p(n+1)}{4}\right]$$

For a function as shown below $$X(k) = [x(k-1)/4 + x(k)/2 + x(k+1)/4]$$

the corresponding time domain processing sequence would be $$= W_N^n\, x(n)/4 + W_N^{-n}\, x(n)/4 + x(n)/2 \text{ where } W_N = e^{-j(2\pi/N)}$$

$$= e^{-2\pi jn/N}\, x(n)/4 + e^{2\pi jn/N}\, x(n)/4 + x(n)/2$$

$$= \tfrac{1}{2}\, x(n)\, [1 + \cos 2\pi n/N]$$

i.e.

$$X(k) <> \tfrac{1}{2}\, x(n)\, [1 + \cos(2\pi n/N)] = F_1[X(k)]$$

$$F_m(X(k)) = x(n)\, [1 + \cos(2\pi n/N)]^m$$

Thus the time domain equivalent of a three-point filtering on the frequency domain is multiplication by $$x(n)[1 + \cos(2\pi n/N)]$$

Frequency compression on the magnitude spectrum is represented by:

$$p(n)=p(3n)$$

where n=1 to 342. 1024 points are compressed to 342 points by sampling every third point. The second derivative peak picking algorithm is represented by:

$$dy/dx=[p(n)-p(n-1)]=0=p'(n)$$

$$p''(n)=[p'(n)-p'(n-1)]=\text{negative.}$$

When both these conditions are met the location of the peak is noted. A maximum of seven peaks can be located in the spectrum but only the four largest are selected.

A speech signal may be regarded as VOICED when $$Ls = 1/M \sum_{N=N}^{N+M-1} a(n)$$

is large and as UNVOICED when $$Ls = 1/M \sum_{n=M}^{N+M-1} a(n)$$

is small AND $$Ld = 1/M \sum_{n=N}^{N+M-1} a(n+1) - a(n)$$

is significant where

Ls=absolute average level of 30 ms of speech

Ld=absolute average level of 30 ms of the differenced signal.

A voiced/unvoiced decision is made depending on the nature of the source of excitation of sounds. A voiced sound is perceived when the glottis is vibrating at a certain pitch causing pulses of air to excite the natural resonating cavities of the vocal tract. Unvoiced sounds are produced by a turbulent flow of air caused by a constriction at some point in the vocal tract. In analysing speech a decision is required to distinguish these so that a correct source of excitation can be used during synthesis. An algorithm can be written to define a voiced speech when the absolute average signal is high and unvoiced when it is rapidly varying and of a small amplitude. If a signal sample is determined to be unvoiced it is disregarded in the analysis process.

The method employed limits the spectral peak resolution of the resulting spectrum. However, it is found that the center frequency and the amplitude of four locally dominant spectral peaks are sufficient information for the auditory system to characterise the short term acoustic properties that distinguish one speech sound from another.

It is also known that auditory neural activities adapt themselves (neural adaption) whereby a high intensity stimulus will quickly reach saturation level. A similar process of adaptive frequency equalization is done on the frequency spectrum by transforming it to a log scale to ensure that the more important higher frequency components are not lost while keeping the stronger low frequency components within dynamic range. Furthermore, only the magnitude spectrum need be considered, since the cochlea is unable to resolve signal phase components.

A property of the cochlear and neural system is that it can only respond to changes of a time constant of the order of 10 ms. It is thus necessary that the processing technique employed extracts and updates its information rate every 10 ms.

Using the above method of processing, the information extracted, that is, the time variation of the spectral peaks movements, can be used as inputs to an implantable hearing prosthesis (such as described in Australian specifications Nos. AU-A 41061/78 and AU-A 59812/80 to mimic the function of the cochlea.

The same information can be used for speech recognition as illustrated in spectral plots against time. Thirdly, using the information acquired, a reverse processing technique can resynthesize intelligible speech either on a digital computer or on a real-time hardware synthesizer.

During resynthesis, each spectral peak position is relocated in the frequency domain, without regard to phase. Three-point digital smoothing is done on these points to spread the spectrum. This would produce a decaying waveform for every pitch period generated in the time domain. The inverse FFT is performed and a data length corresponding to a pitch period is extracted.

For unvoiced speech, the spectrum is multiplied by a random phase function prior to inverse FFT. A 600 Hz bandwidth for the noise spectral peak is satisfactory. The next set of data is decoded similarly until the end of the utterance.

Figure 16:
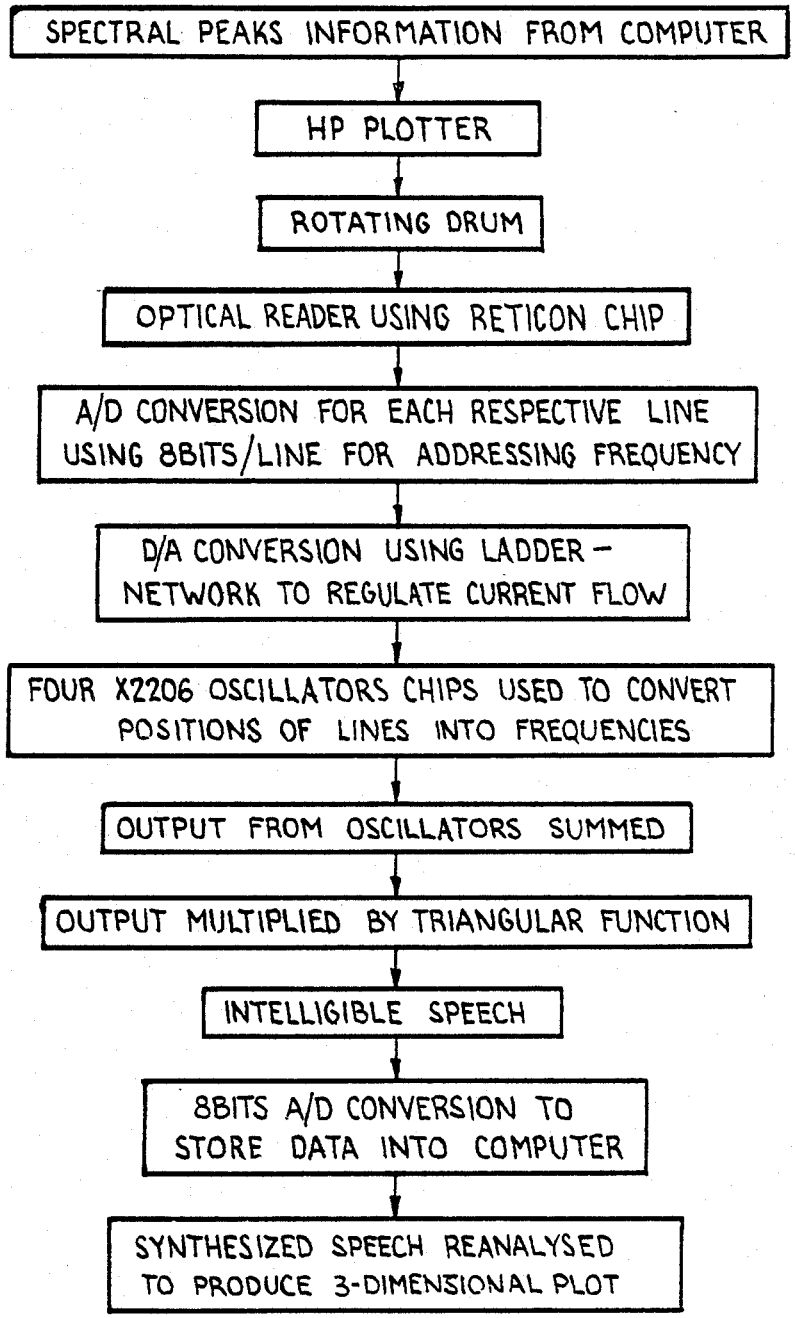
FIG. 16 is a schematic representation of a real-time speech synthesizer.
Figure 18:
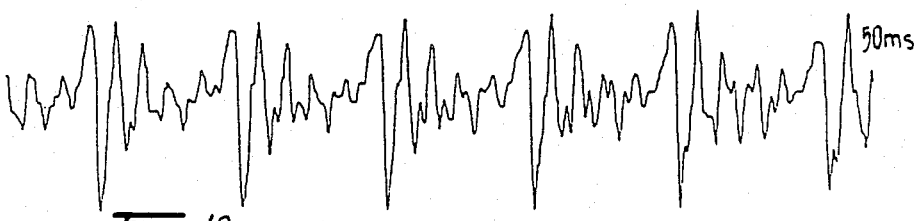
FIGS. 18 to 23 show the steps in an alternative processing method.
Figure 19:
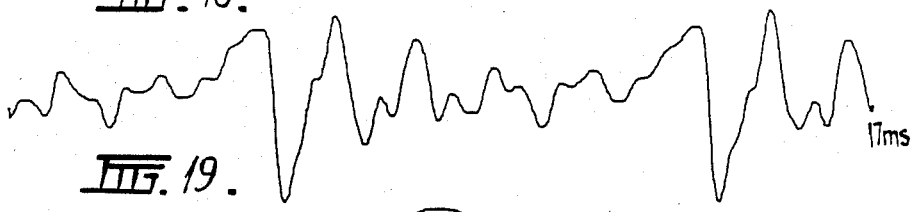
Figure 20:
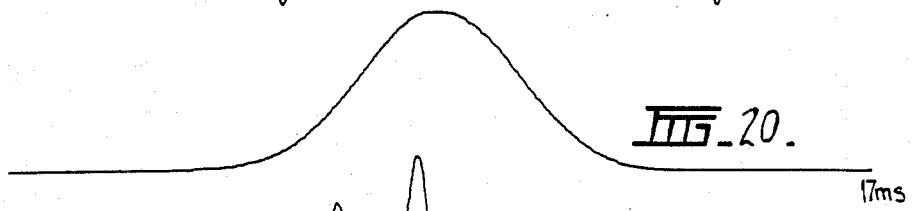
Figure 21:
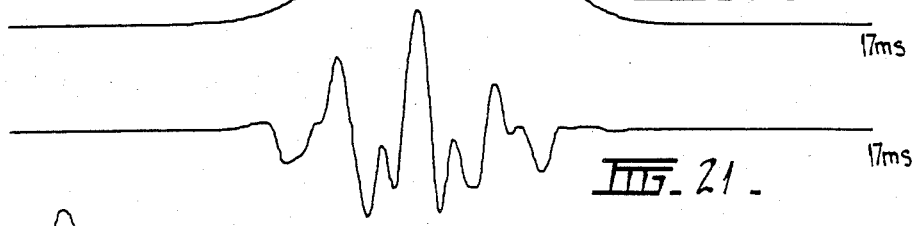
Figure 22:
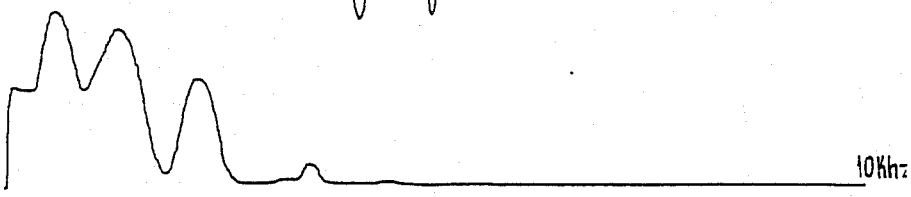

An alternative real-time speech synthesizer shown schematically in FIG. 16 converts spectral lines into sine waves of frequencies from 0.3 Khz. A linear 256-pixels RETICON chip is used. It is enclosed inside a commercial camera with focus and aperture size adjustments. The camera is mounted on an optical bench with a rotating drum at right-angles to it. Four controlled oscillators using X2206 function generator chips are required.

A start pulse every 10 ms is used to start the count to locate the position of each line. A maximum of four lines may be identified, and the position of each line is decoded as an 8-bit address. The address is then latched, so that the D/A of each line is in continuous operation throughout the 10 ms period. If the position of the line changes in the next 10 ms, a 'new' address is latched. If the line disappears an analogue switch will disable the oscillator.

The D/A comprises a ladder-network to allow up to 8-bits of accuracy in determining the current flow into the X2206 oscillator chip.

$$\text{Frequency}=320\ I(mA)/C(\mu F)\ Hz.$$

Having set a fixed capacitance, the frequency generated by the chip is only dependent of the position of the line. The output from the four oscillators are summed and multiplied by a triangular wave function with an offset. This procedure will generate a pitch period as well as spreading the spectrum wider as it appears in normal speech.

A typical line input representing the word 'Melbourne' is shown in FIG. 17. In FIG. 17A the base line has been removed since this does not contain any information and may be replaced by a straight line as shown. It has been established above that the variation with time of the frequencies at which the spectral energy maxima occur contains all the information necessary to resynthesize the spoken words. Moreover we have found that the changes in amplitude of the maxima are unimportant in resynthesizing understandable words (though they may be important in speaker identification) and the actual pitch frequency used is not critical at all. In this respect in particular the approach of this invention differs from that of others which endeavour to determine pitch frequency accurately. In the resynthesis process the outputs of three or four tone generators whose frequencies are controlled by the frequency peak 'tracks', are combined, and finally a tone representing the pitch frequency added in. This last step is not actually essential for intelligibility, but improves realism.

Figure 23:
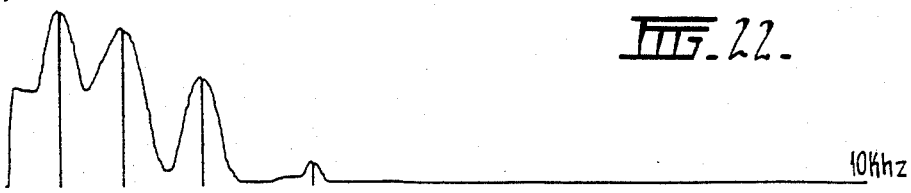

The second processing method, which can be shown to be mathematically equivalent of the first method using processing of the speech signal or time domain data, will now be briefly explained with reference to FIGS. 18 to 23. This processing method involves the following steps:

(a) A segment of the time waveform of the same utterance BOAT. (FIG. 18),
(b) Time expansion of the speech segment (FIG. 19),
(c) Applying a filtering or smoothing function of the form $(1+\cos(\pi t/T))^N$ (FIG. 20) to the time expanded speech segment,
(d) Resulting waveform after filtering or smoothing (FIG. 21),
(e) Obtaining a magnitude spectrum using at least 1024 points Fast Fourier transform,
(f) Log of the magnitude spectrum (FIG. 22), and
(g) Four dominant peaks are located (FIG 23).

As in the case of the embodiment of FIG. 7, each of the above operations are performed using a suitably programmed general purpose computer.

As mentioned above, other methods of achieving the same results may be easily devised using standard mathematical procedures. Similarly, the processing techniques by which the above described alternative processing steps may be performed in a computer will be well understood by persons skilled in the art and will not therefore be described in greater detail in this specification. The manner in which the extracted information is utilized will vary according to the application and although the processing technique was developed with application to a hearing prosthesis in mind, the technique clearly has wider application, several of which have been indicated above. Other applications include:

Control of plant and machines by spoken command.

Aids for handicapped—voice operated wheel chairs, voice operated word processors and braille writing systems.

Voice operation of computers.

Automatic information systems for public use activated by spoken commands.

Automatic typescript generation from speech.

We claim:

1. A method for extracting recognition information from a speech signal, comprising the steps of transforming time segments of the speech signal into respective successive spectrums, performing a smoothing function on each spectrum to suppress low amplitude peaks at harmonics of the pitch frequency in each spectrum, and identifying and tracking both continuous and discontinuous spectral peaks in the successive smoothed filtered spectrums.

2. A method as claimed in claim 1 wherein the step of performing a smoothing function includes smoothing each spectrum so as to suppress low amplitude narrow bandwidth peaks in each spectrum.

3. A method as claimed in claim 1 wherein the step of performing a smoothing function includes performing a three point smoothing algorithm on magnitude data of adjacent frequencies.

4. A method as claimed in claim 3 wherein the step of transforming includes Fourier transforming.

5. A method as claimed in claim 4 including the step of testing each time segment of the speech signal prior to the transforming step to determine whether the time segment is voiced or unvoiced; and proceeding with the steps of transforming, performing a filtering function, and identifying and tracking only on time segments found by the testing step to be voiced.

6. A method as claimed in claim 5 including the step of applying a Hamming window to each time segment found to be voiced in the testing step and prior to the transforming step so that time segment edges are smoothed to eliminate false artifacts in the spectrum.

7. A method for extracting recognition information from a speech signal, comprising the steps of (a) sampling and analog-to-digital converting the speech signal into speech signal data;
(b) taking overlapping displaced time segments of the speech signal data;
(c) testing each time segment to determine whether the time segment is voiced or unvoiced, and performing the following steps only on time segments determined by said testing to be voiced;
(d) applying a Hamming window to each voiced time segment;
(e) performing a fast Fourier transform on each voiced time segment to which a Hamming window has been applied to obtain corresponding magnitude spectrums;
(f) logarithmically converting each magnitude spectrum to obtain logarithmic magnitude spectrums;
(g) compressing each logarithmic magnitude spectrums by selecting every xth point of the logarithmic magnitude spectrum wherein x is the compression factor to obtain corresponding compressed spectrums;
(h) performing the following three-point smoothing algorithm on each compressed spectrum $$p(n) = \frac{p(n-1)}{4} + \frac{p(n)}{2} + \frac{p(n+1)}{4}$$

a plurality of times, wherein $p(n-1)$, $p(n)$ and $p(n+1)$ are successive points in each compressed spectrum;
(i) expanding each filtered and compressed spectrum to obtain corresponding expanded filtered spectrums; and
(j) locating dominant peaks in the expanded filter spectrums to extract the recognition information of the speech signal.

8. A method for extracting recognition information from a speech signal, comprising the steps of transforming time segments of the speech signal into respective successive spectrums;

performing a smoothing function on each time segment of the speech signal prior to the transforming step so that low amplitude peaks at harmonics of the pitch frequency are suppressed in each spectrum; and identifying and tracking both continuous and discontinuous spectral peaks in the successive smoothed spectrums.

9. A method as claimed in claim 8 wherein the step of performing a smoothing function includes performing a function on each time segment of the speech signal prior to the transforming step so that low amplitude narrow bandwidth peaks are suppressed in each spectrum.

10. A method as claimed in claim 8 wherein the function performed on each time segment of the speech signal is an algorithm of the form: $(1+\cos(\pi t/T))^N$.

11. A method as claimed in claim 8 wherein the transforming step includes Fourier transforming.

12. A method as claimed in claim 10 wherein the transforming step includes Fourier transforming.

13. A method as claimed in claim 12 further including the steps of sampling and analog-to-digital converting the speech signal into speech signal data;

taking overlapping displaced blocks of the speech signal data;

time expanding each block of data to obtain said corresponding time segments of the speed signal which are then subjected to the function performing and transformation steps.

14. A method as claimed in claim 11 wherein the Fourier transforming step includes performing a fast Fourier transform.

15. A system for extracting recognition information from a speech signal, comprising means for transforming time segments of the speech signal into respective successive spectrums;

means for performing a smoothing function on each spectrum to suppress low amplitude peaks at harmonics of the pitch frequency in each spectrum, and means for identifying and tracking both continuous and discontinuous spectral peaks in the successive smoothed spectrums.

16. A system as claimed in claim 15 wherein the means for performing a smoothing function includes means for performing a smoothing function on each spectrum so as to suppress low amplitude narrow bandwidth peaks in each spectrum.

17. A system for extracting recognition information from a speech signal, comprising means for transforming time segments of the speech signal into respective successive spectrums;

means for performing a smoothing function on each time segment of the speech signal prior to the transforming step so that low amplitude peaks at harmonics of the pitch frequency are suppressed in each spectrum; and means for identifying and tracking both continuous and discontinuous spectral peaks in the successive spectrums.

18. A system as claimed in claim 17 wherein the means for performing a smoothing function includes means for performing a function on each time segment of the speech signal prior to the transforming step so that low amplitude narrow bandwidth peaks are suppressed in each spectrum.

* * * * *